US005452599A

United States Patent [19]

Daudi et al.

[11] Patent Number: 5,452,599

[45] Date of Patent: Sep. 26, 1995

[54] METHOD AND APPARATUS FOR PRODUCING VEHICLE WHEEL RIMS

[75] Inventors: Anwar R. Daudi; William R. Fowler, both of East Lansing, Mich.

[73] Assignee: Motor Wheel Corporation, Mich.

[21] Appl. No.: 165,910

[22] Filed: Dec. 14, 1993

[51] Int. Cl.[6] ..... B21D 53/30

[52] U.S. Cl. ..... 72/393; 29/894.353

[58] Field of Search ..... 72/353.4, 353.6, 72/393; 29/894.353

[56] References Cited

U.S. PATENT DOCUMENTS

| | | | |
|---|---|---|---|
| 442,598 | 12/1990 | Knight . | |
| 887,727 | 5/1908 | Kelly . | |
| 1,838,892 | 12/1931 | Vis . | |
| 1,926,400 | 9/1933 | Palmer . | |
| 1,997,323 | 4/1935 | Strnad . | |
| 2,122,044 | 6/1938 | Powell . | |
| 2,292,054 | 8/1942 | Cleveland . | |
| 2,442,965 | 6/1948 | Thomas . | |
| 2,629,421 | 2/1953 | Ayres . | |
| 2,684,103 | 7/1954 | Lee et al. | 72/353.4 |
| 2,740,450 | 4/1956 | Grotnes . | |
| 2,826,161 | 3/1958 | Palmer . | |
| 3,172,787 | 3/1965 | Martenet . | |
| 3,190,134 | 6/1965 | Sadler et al. . | |
| 3,298,218 | 1/1967 | Gollwitzer . | |
| 3,349,599 | 10/1967 | Ullman et al. | 72/393 |
| 3,382,699 | 5/1968 | Seeman . | |
| 3,564,898 | 2/1971 | Stettler . | |
| 3,706,120 | 12/1972 | Bulgrin . | |
| 3,729,795 | 5/1973 | Roper . | |
| 3,834,214 | 9/1974 | Kralowetz . | |
| 4,098,108 | 7/1978 | Kozima . | |
| 4,561,275 | 12/1985 | Itou et al. . | |
| 4,809,529 | 3/1989 | Shinozawa et al. . | |
| 5,010,759 | 4/1991 | Yokomizo et al. . | |

FOREIGN PATENT DOCUMENTS

| | | | |
|---|---|---|---|
| 3318516C2 | 11/1984 | Germany . | |
| 143023 | 5/1992 | Japan | 72/393 |
| 483172 | 9/1975 | U.S.S.R. . | |

*Primary Examiner*—Lowell A. Larson
*Attorney, Agent, or Firm*—Barnes, Kisselle, Raisch, Choate, Whittemore & Hulbert

[57] ABSTRACT

Expanding apparatus and method for sizing a one-piece drop-center wheel rim having first and second ganged arrays of rim sizing die segments insertable into the rim from one side thereof, and a third array of rim sizing die segments insertable into the opposite side of the rim, all three arrays cooperating to form a complete array of die segments for expansion sizing of the rim. A single wedge mechanism moves the arrays radially outwardly to individually size the inboard bead seat, outboard bead seat and drop-center well zones of the rim in response to relative coaxial movement of the wedge and arrays in a rim expansion working stroke along a longitudinal axis of the wedge. The wedge includes an expansion cone mechanism comprising first, second and third cone cams respectively individually operably associated with the first, second and third die arrays for radially expanding the same in such working stroke. A set-up adjustment mechanism disposed interiorly of the wedge has three concentrically arranged lead screws individually threadably coupled to each of the cone cams for carrying and selectively positioning the same along the longitudinal axis of the wedge to thereby vary the set-up end limit of radially outward movement of the associated die segment array for a given relative working stroke of the wedge means and arrays. A gear drive coupled to the exterior end of each lead screw individually rotates, and is driven either manually or by the same servo motors operably coupled to each worm gear drive. Cone cam position sensors each develop a signal indicative of the axially adjusted set-up position of each associated cone cam. A signal processing control system utilizes the signals for controlling the servo motors to drive the cone cams and thereby control their adjusted set up positions.

32 Claims, 4 Drawing Sheets

(DIES EXPANDED)

METHOD AND APPARATUS FOR PRODUCING VEHICLE WHEEL RIMS

FIELD OF THE INVENTION

The present invention relates to a method and apparatus for use in the manufacture of wheel rim members, and more particularly for truing roundness and size of tire-carrying wheel rims by permanent deformation expansion of the same. Although the present invention may be employed for expanding various types and sizes of vehicle wheel rims, it finds particular utility in expanding rims of the one-piece drop-center type.

BACKGROUND OF THE INVENTION

In the manufacture of vehicle wheel drop-center rims as now commercially produced, a strip of sheet metal stock cut to suitable width and length is coiled and the strip ends flash-butt-welded together to provide an annular element. The axial end portions of the annular element are flared outwardly in a flaring station and then the flared annular element is roll-formed in one or more roll-forming machines to provide a rim element having a rough drop-center rim contour and which is slightly diametrically undersize relative to rim final dimensions. The rolled rim element is then conveyed to a shaping apparatus, usually called an expander, in which the rim element is diametrically expanded by a segmental expansion die fixture to circumferentially stretch the material beyond its yield point to thereby impart a permanent set to the material at an enlarged finished diameter. Rim expander apparatus of this character is disclosed in Palmer U.S. Pat. No. 1,926,400 and in Yokomizo et al U.S. Pat. No. 5,010,759.

Such rim expanding apparatus is provided with radially movable shaping die segments arranged in a circular array and cooperating at their radially outermost surfaces to form an annular peripheral surface corresponding to the cross-sectional contour of the rim to be expanded. The die segments are moved from their innermost retracted positions radially outwardly into engagement with the rim to diametrically expand the rim a predetermined amount to circumferentially stretch and permanently set the rim material to thereby both accurately size and impart a true circular contour to the rim.

Such rim expanders developed for use with channel or drop-center wheel rims are typically provided with two sets of axially opposed segmental die fixtures adapted to be mounted one each on fixed and movable members of a horizontal or vertical axis press. The press mounted die fixtures are thus coaxially relatively movable and axially separable from one another to permit loading of a rim workpiece therebetween. The opposed fixtures are respectively inserted into the inboard and outboard ends of the rim and are closable together into abutment at a press parting line located by reference to the minimum inside diameter of the rim element to be worked. With this arrangement, the jaws or die segments need only have a short travel on their radial expansion working stroke despite the relatively large difference between the internal and external diameters of the typical drop-center rim. A short radial travel stroke of the die segments are important in reducing the amount of circumferential spacing between the individual sizing die segments of the segmental die in their fully expanded condition so as to minimize the rim "chording" phenomenon induced by the circumferential gaps between the expanded die segments.

The closed die set parting line location may be arranged to intersect the mid-point of the drop-center well, whereby each die set would engage the corresponding half of the rim well. More typically, however, one of the die sets is designed with its sizing die segments to engage the entire inner surface of an annular zone of the rim including one of the bead seats, an associated tire bead retaining flange and the drop-center well, and to abut the cooperating die set at a parting line located at the edge of the rim well remote from such bead seat. Hence this die set expands the drop-center well and one associated rim bead seat and flange, whereas the other opposed die set only expands the opposite bead seat and its associated flange.

In such known rim expanding apparatus, the two opposed segmental die sets may be individually expanded by two coaxially opposed and movable conical wedge expanding members, such as disclosed in the Bulgrin U.S. Pat. No. 3,706,120 (FIG. 8) and in the aforementioned Yokomizo et al U.S. Pat. No. 5,010,579 (FIGS. 4 and 5). However, it is preferred to use a single conical wedge expanding member for radially expanding both segmental die sets as disclosed in the Palmer U.S. Pat. No. 1,926,400, Bulgrin U.S. Pat. No. 3,706,120 (FIGS. 2–5) and Yokomizo et al U.S. Pat. No. 5,010,579 (FIGS. 1 and 2).

One well known and longstanding problem associated with such rim expanding apparatus is the prolonged set-up time required to accurately adjust each of the die segments of each of the segmental die sets. Typically each die segment is removably secured on a radially movable die holder of the die set to permit interchanging the same for expanding different types and sizes of rims. In order to accommodate such set-up changes as well as to make rim sizing adjustments to compensate for wear and stock thickness variations during a given production run, it has been necessary to individually disassemble and reassemble, either completely or partially, each die segment in order to manually insert properly selected shim stock between such segment and its associated holder to thereby adjust within precise tolerances the annular periphery presented by the die segment array to the rim. Inasmuch as each die set typically may contain as many as sixteen die segments, it often requires up to two hours or more for skilled set-up personnel to shim adjust the die set to change rim bead seat diameters (and thus the associated rim well diameter as a dependent variable). Obviously this is a costly procedure in terms of both labor and production line down-time.

Another problem with such prior rim expanding apparatus is that rim well inside diameter and either or both of the rim bead seat outside diameters are not independently adjustable relative to one another. Such dimensions of each of these three critical elements of the rim, as well as their roundness and concentricity relative to one another, are all well recognized as important quality control parameters which must be closely monitored in modern high speed mass production of wheel rims and disc assemblies. The inside diameter of the rim well must be closely controlled because, after the rim expansion station operation, the rounded and sized rim is conveyed to a disc assembly station where a wheel disc is telescopically press fit into the rim well. This rim and disc assembly is then conveyed to a subsequent station where the disc is welded to the rim. Hence, roundness and precise dimensional control of the rim well inner periphery are essential for optimizing the disc press-in production operation regardless of the roundness and diameter of the inboard and outboard bead seats of the rim.

On the other hand, it is also critical that each of the rim bead seats be finished to their outside diametrical dimensions within very close tolerances in a uniform manner. The bead seats also must be both round and concentric with one another as well as with the inner periphery of the rim well within very close tolerances.

Hitherto it has not been possible to independently control all three of these annular zones in the rim expanding operation because of the fixed relationship of the die segment surfaces in the one of the die fixtures which expands concurrently both the rim well and one of the rim bead seats. Accordingly, it has been difficult and costly in terms of set-up readjustment and production scrap rate to maintain the desired mass production uniformity with respect to the dimensional parameters of both the rim itself and the disc and rim wheel assembly in order to minimize radial run-out of the rim bead seats in the wheel assembly as well as disc-to-rim assembly defects.

OBJECTS OF THE INVENTION

Accordingly, an object of the present invention is to provide an improved rim expand sizing method, and an improved apparatus for performing the method, which overcome the aforementioned problems in a reliable and economical manner.

Another object of the present invention is to accomplish a substantial improvement in the manufacture of drop-center wheel rims by providing a rim expand sizing apparatus capable of expanding rims to an overall predetermined size while at the same time insuring true forming and control of each of the three critical dimensional zones of the drop-center rim, namely (1) outboard bead seat outside diameter, (2) inboard bead seat outside diameter and (3) rim well inside diameter, to thereby produce a finished rim having these three zones in a round, mutually concentric and desired dimensioned condition within very close tolerances regardless of the differences in design diameter of each of these three zones.

Yet another object of the present invention which contributes materially in securing the foregoing advantageous results is to provide an improved rim expanding sizing segmental die apparatus having three sets of radially moving expanding die segments wherein each set is adjustable independently of the other two sets but operable conjointly to individually respectively expand the rim outboard and inboard bead seats and rim well.

A further object of the present invention is to provide an improved rim expand sizing apparatus having opposed multiple arrays of radially expandable segmental dies for separately expanding different portions of a wheel rim and wherein each die array is rapidly, accurately and economically adjustable for set-up independently of the remaining die array or arrays without the need for shimming and/or re-shimming the individual die elements or jaws in either initial or running set-up adjustment of each die array.

Still another object is to provide an improved rim expander of the aforementioned character in which each of the die arrays of the multiple die sets of the expander die is individually and separately adjustable by an improved set-up mechanism operably coupled for access and driving control exteriorly of the rim sizing apparatus such that set-up adjustment can be performed without the use of shims and without requiring access to the individual die arrays.

Yet another object is to provide an improved rim expander of the aforementioned character having a feedback mechanism providing automatic rim sizing set-up adjustment on a selective basis of one or more of the multiple arrays of expandable segmental dies of the expansion die set, and under closed loop control on a running basis from rim to rim during production to thereby compensate for variations occurring during production and to better maintain precise and uniform control of rim size and other geometrical rim parameters.

BRIEF DESCRIPTION OF THE DRAWINGS

These and other objects, features and advantages of the present invention will become more apparent from the following detailed description of a presently preferred embodiment of the invention taken in conjunction with the accompanying drawings (which are scaled from engineering drawings unless otherwise indicated), in which.

DETAILED DESCRIPTION OF THE PREFERRED EMBODIMENT

Figure 1A:
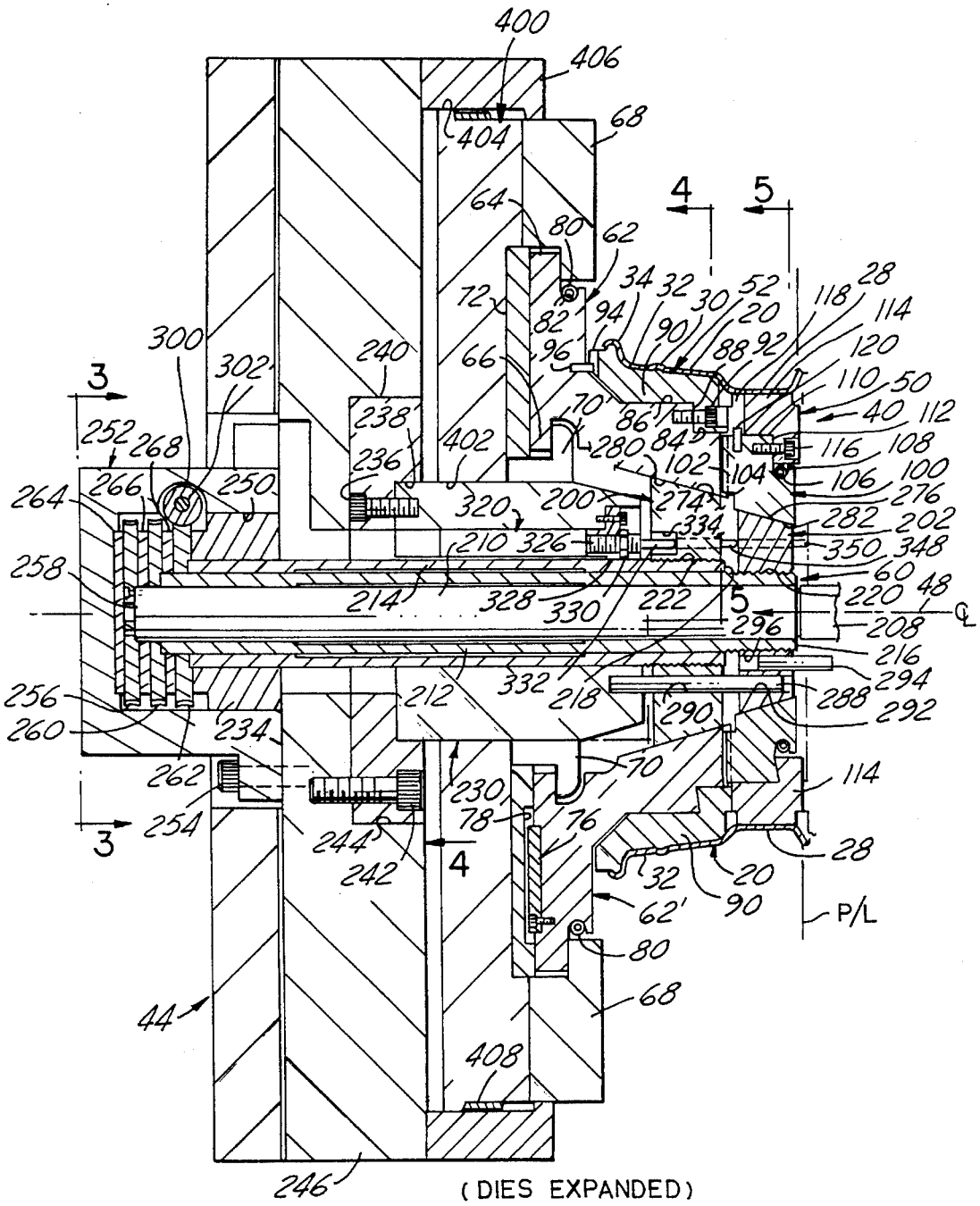
FIG. 1A is a vertical centerline sectional and fragmentary view of an exemplary but presently preferred embodiment of a wheel rim expander apparatus constructed in accordance with the present invention, and illustrating rim-inboard-bead-seat and rim-well sets of segmental expand die arrays shown mounted on the headstock of a horizontal axis-type rim expanding press or machine in its fully closed condition at the completion of a working stroke, and with the die arrays shown radially expanded to their final work position.
Figure 1B:
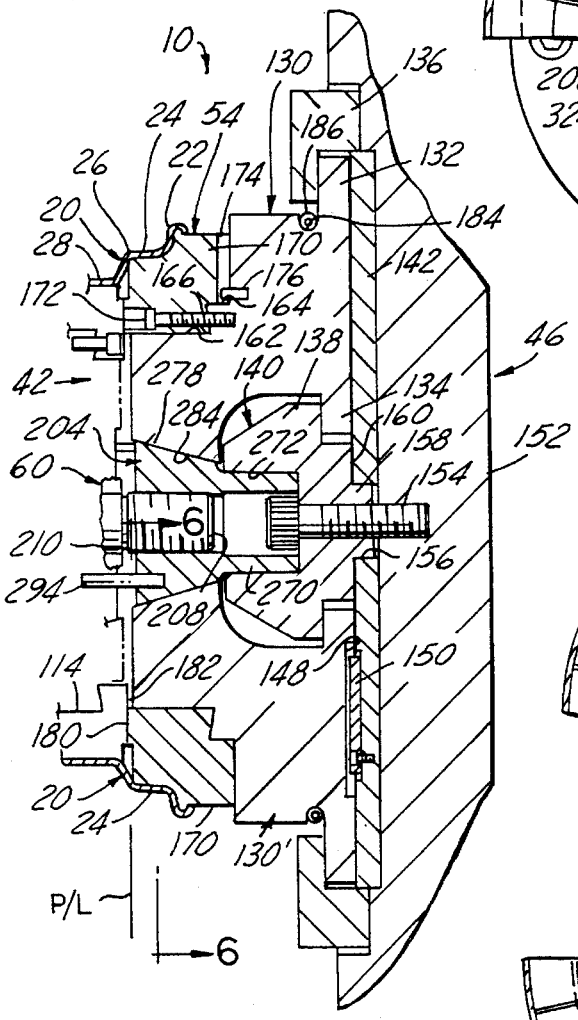
FIG. 1B is an extension of FIG. 1A and a corresponding sectional and fragmentary view illustrating the remaining portion of the rim expander apparatus of the invention, i.e., the rim-outboard-bead-seat set segmental expand die array mounted on the tailstock of the machine and likewise shown radially expanded to final work position.

A wheel rim expander sizing apparatus of the present invention may have a vertical orientation wherein a conical wedge die expander extends on a vertical axis and the segmental die sets are mounted as rim expand tooling in opposed vertically separable punch and die platens of a press. However, as illustrated herein a horizontal orientation is utilized wherein the conical wedge expander extends in a horizontal direction in a horizontally separable headstock and tailstock type rim expander machine. Moreover, the rim expanding apparatus of the invention may be employed advantageously in expanding rims of various cross-sectional contours and sizes. Nevertheless, for the purpose of illustrating that the rim expanding apparatus of the present invention definitely solves existing problems in the high volume, rapid mass production manufacture of drop-center rims, such apparatus, generally designated as 10 in FIGS. 1A and 1B, is shown as employed in connection with this latter type of rim. It is also to be understood that the terms "outboard" and "inboard" are used for purposes of convenience in description rather than by way of limitation, and refer to the orientation of the wheel rim structure relative to the vehicle on which it is mounted when in road wheel use.

Referring in more detail to FIGS. 1A and 1B, a conventional one-piece wheel rim 20 of the drop-center type is shown mounted on the rim expanding apparatus 10 of the invention in a fully expanded, sized and rounded condition at the completion of the working stroke of the apparatus. Rim 20 has the usual outboard tire bead retaining flange 22, outboard tire bead seat 24, outboard safety hump 26 (FIG. 1B), drop-center well 28, inboard safety hump 30, inboard tire bead seat 32 and inboard tire bead retaining flange 34 (FIG. 1A).

In general, rim expanding fixture 10 comprises a headstock segmental dual die set 40 (FIG. 1A) and a tailstock segmental single die set 42 (FIG. 1B) respectively mounted on the headstock 44 and tailstock 46 of a conventional horizontal-type rim expanding machine. Die sets 40 and 42 are mounted for movement by the machine and relative to each other along a common center line horizontal axis 48 of the machine. Headstock die set 40 comprises two independent circular arrays of jaws or die segments 114 and 90 respectively constructed and arranged as set forth in more detail hereinafter to form a rim-well-expand segmental die set array 50 and a rim-inboard bead-seat-expand segmental die set array 52. Tailstock die set 42 comprises a circular array of die segments 170 cooperating to form a rim outboard-bead-seat-expand segmental die set array 54 (FIG. 1B) carried on tailstock 46 (FIG. 1B).

When tailstock 46 is machine moved axially relative toward headstock 44 into the die-closed condition (indicated in phantom in FIGS. 1A and 1B, and better seen in FIG. 2), die array 54 abuts die array 50 at the fixture parting line P/L. In such die-closed condition the peripheral surfaces of die arrays 54, 50 and 52 together correspond in configuration to the cross-sectional contour of the radially inwardly facing surfaces of rim 20 as and when expanded to finished form (FIGS. 1A and 1B). The individual die segments 114, 90 and 170 of die arrays 50, 52 and 54 respectively are identical with one another within a given array. Die segments 114, 90 and 170 are preferably readily removably secured in place so as to permit expediently interchanging the same for other die segments of different sizes and configurations so that the same machine can be used for expanding different types and sizes of rims.

The illustrated embodiment of the rim expanding fixture of the invention is constructed and arranged for use with a single-type expanding conical wedge assembly 60 which is fixed at one end to headstock 44 for cantilever support therefrom. Wedge assembly 60 thus is adapted to extend horizontally coaxially through both headstock fixture 40 and tailstock fixture 42, and functions upon movement of fixtures 42 and 40 as a unit to the left (as viewed in FIGS. 1 and 2) to operably slidably engage the segmental die fixtures 40 and 42 and, by a wedging action, force the die arrays 50, 52 and 54 radially outwardly conjointly into expanding engagement with rim 20.

Figure 2:
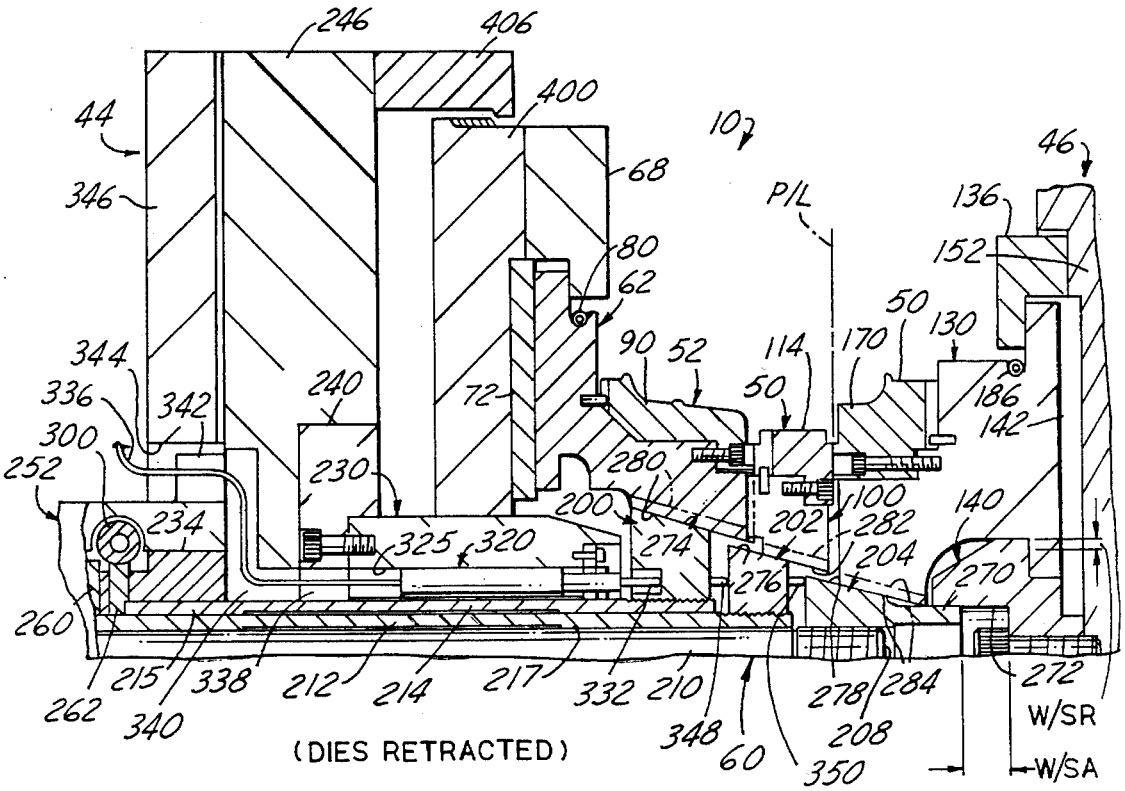
FIG. 2 is a vertical half-sectional view of the apparatus shown in FIGS. 1A and 1B with the opposed die sets shown in initially closed condition with the expansion die elements shown in their retracted work position at the beginning of the working stroke.

Tailstock 46 and fixture 42 carried thereon are separable in the machine cycle from headstock 44 and fixture 40 carried thereon by a distance sufficient to permit a rolled rim workpiece to be conveyed into loading position therebetween. Closing movement of tailstock 6 (to the left as viewed in FIGS. 1 and 2) will cause the rolled rim workpiece to be telescoped loosely over the retracted die arrays 50, 52, 54 as the tailstock die array 54 moves into abutting engagement with the headstock die array 50, as shown in FIG. 2 (rough rolled rim workpiece not shown). In this initially closed, loaded condition of fixtures 40 and 42, the three die arrays 50, 52 and 54 form a complete segmental die assembly and are in their fully radially retracted position shown in FIG. 2. Continued movement of tailstock 46 to the left causes its fixture 42 to push headstock fixture 40 along with it so that fixtures 40 and 42 move axially as a unit along wedge expander 60 through a predetermined working stroke of axial travel designated "W/SA" in FIG. 2. Such movement of both fixtures 42 and 40 leftward and co-axially relative to wedge 60 causes the wedge to slidably engage and force the three die arrays 50, 52 and 54 radially outwardly as a unit, through a corresponding predetermined working stroke radial travel "W/SR" (FIG. 2), into radially expanding engagement with the rolled rim workpiece to size and shape expand the same into finished rim 20.

More particularly, headstock fixture 40 comprises a circular array of a plurality of rim-inboard die holders 62, e.g., sixteen in number herein and identical with one another (FIG. 1A and 2). Holders 62 each have outer and inner flanges 64 and 66 respectively slidably captured by keeper rings 68 and 70 for holding die holder 62 in sliding abutment with a circular keyway plate 72. The lowermost inboard die holder 62' of this array is sectioned in FIG. 1A to illustrate a key 76 removably affixed thereto and slidably received in an associated keyway 78 of ring plate 72 (it being understood that each of the remaining inboard die holders 62 are likewise keyed for radial sliding movement against ring plate 72). An endless tension coil spring 80 is trained through a groove 82 in each holder 62 so as to encircle and yieldably bias the array of holders 62 radially inwardly toward the fully retracted position thereof shown in FIG. 2. Each die holder 62 is provided with stepped locating surfaces 84 and 86 and a shoulder 88 against which is seated an associated rim-inboard die segment 90. Each segment 90 is removably affixed to its associated holder 62 by a pair of machine screws 92, and is provided with a slot 94 which registers with a locating pin 96 fixed in the associated inboard die holder 62.

In accordance with one feature of the present invention, headstock rim expansion fixture 40 is made up of the two segmental rim expansion die arrays 50 and 52 operably coupled for ganged, unitary movement axially of the fixture but capable of movement radially of the fixture independently of one another. Die array 52 is operable to engage only the radially inwardly facing surface of an annular rim inboard zone of the rolled rim workpiece, this inboard zone extending inboard from a radial plane located just inboard of rim well 28 to and including inboard rim flange 34. Die segments 90 are thus contoured on their radially outward facing surfaces to expand form the safety hump 30, inboard bead seat 32 and inboard tire bead retaining flange 34 of rim 20. On the other hand, die array 50 is constructed and arranged to engage solely the radially inwardly facing surface of the annular rim well zone containing rim well 28 to expand form only the same.

Die array 50 comprises a plurality (e.g., sixteen) of die holders 100, one carried on each of the inboard holders 62, and each having a dove tail 102 slidably radially of the array in a dove tail slot 104 in the outer face of the associated holder 62. An endless tension coil spring 106 seats in a groove 108 of each holder 100 and encircles the entire array of holders 102 for yieldably biasing them radially inwardly to the retracted position shown in FIG. 2. Each holder 100 is provided with a locating surface 110 and a slightly inclined undercut shoulder 112 for removably seating thereon an associated rim well expand die segment 114. Each die segment 114 is removably affixed to its associated holder 100 by a pair of machine screws 116 and is provided with a locating slot 118 which registers with a locating pin 120 fixed in the associated holder 100.

It will thus be seen that the array of well die segments 114, although gang supported by their associated holders 100 on the associated inboard holders 62 for movement axially as a unit therewith, are nevertheless freely movable radially relative to inboard die segments 90. Hence the radially adjusted set-up positions of the well expand die array 50 and rim inboard die array 52 can be varied independently of one another, either by conventional manual shimming practice or preferably by utilizing the wedge cone adjustment features of the invention described hereinafter.

Referring to FIG. 1B, tailstock fixture 42 comprises a plurality (e.g., sixteen) of die holders 130 each with outer and inner flanges 132 and 134 respectively slidably clamped by a keeper ring 136 and by a flange 138 of a guide plug 140 into radial sliding abutment against a keyway plate 142. As illustrated by the sectioning of the lowermost die holder 130, in FIG. 1B, each holder 130 has a keyway 148 which slidably receives a key 150 affixed to plate 142. Guide plug 140 is removably fastened by a machine screw 154 threaded into a platen 152 of tailstock 46. Plate 142 has a center hole 156 receiving a nose 158 of plug 140, and a shoulder 160 of plug 140 clamps plate 142 against platen 152.

Each die holder 130 has a pair of locating surfaces 162 and 164 and an undercut shoulder 166 against which an individually associated outboard die segment 170 is removably seated. Each die segment 170 is removably affixed to its associated holder 130 by a pair of machine screws 172, and has a locating slot 174 registering with a locating pin 176 affixed to the associated die holder. The inboard faces 180 of each outboard die segment 170 define a common radial plane adapted to abut at the parting line P/L the corresponding faces 182 of the associated well die segments 114 in the closed condition of fixtures 40 and 42.

It will thus be noted that the rim outboard expand segmental die array 54 also is radially adjustable for set-up independently of either or both the rim well expand die array 50, and rim inboard expand die array 52. Die segments 170 are identically configured on their outer surfaces to engage the radially inwardly facing surface of the annular zone outboard of rim 20, extending outboard from the outboard edge of rim well 28, and to thereby expand form the rim outboard safety hump 26, outboard bead seat 24 and associated rim outboard tire bead retaining flange 22. Each of outboard die holder 130 is provided with a groove 184 to receive an encircling endless tension coil spring 186 for yieldably biasing the array of outboard die holders to the retracted position as shown in FIG. 2.

In accordance with a further feature of the present invention, the expanding wedge mechanism 60 carries three independently adjustable expanding cone cams 200, 202 and 204 (FIGS. 1 and 2) respectively individually associated with die arrays 52, 50 and 54. The rim outboard expand cone 204 is threadably received on the threaded free end 208 of a solid center shaft 210 of wedge mechanism 60. Center shaft 210 rotatably carries inner and outer concentric sleeves 212 and 214 constructed and arranged at their respective free ends 216 and 218 in a stepped, axially offset receding array relative to protruding shaft end 208 (FIG. 1A). Sleeves 212 and 214 are externally threaded at 220 and 222 respectively to threadably receive respectively thereon cones 202 and 200.

As best seen in FIG. 1A, outer shaft 214 is rotatably journalled in a pair of axially spaced bushings 230 and 234. Bushing 230 is cantilever mounted by machine screws 236 in a socket 238 of a mounting plate 240 which in turn is fastened by machine screws 242 in a socket 244 of a platen 246 of headstock 44. Bushing 234 is supported in a bore 250 of a flanged cup housing 252 fastened by machine screws 254 to platen 246. Inner sleeve 212 is journalled for rotation in the spaced internal lands 215 of outer sleeve 214, and likewise center shaft 210 is journalled for rotation in the spaced internal lands 217 of inner sleeve 212.

Three worm gear drives are provided in housing 252 for individually rotating shaft 210 and sleeves 212, 214. A worm helical gear 256 is affixed to the housing end 258 of shaft 210, and likewise worm helical gears 260 and 262 are respectively affixed to the axially stepped back housing ends of sleeves 212 and 214. These three gears are captured in spaced apart relationship between bushing 234 and the end wall of housing 252 by interposed journal spacers 264, 266 and 268. This housing and bushing mounting configuration thus secures wedge expanding mechanism 60 in cantilever fashion to the fixed platen 246 of headstock 44.

Referring to FIGS. 1B and 2, in the closed condition of die fixtures 40 and 42 the free end of wedge mechanism 60 is slidably supported by tailstock 46 due to a hollow nose sleeve portion 270 of outboard expand cone 204 being coaxially slidably received in a guide bore 272 of plug 140. When tailstock 46 is retracted away from headstock 44 in order to load a rolled rim workpiece, or to unload a finished sized rim 20, nose sleeve 270 is completely withdrawn from guide plug 140. Hence in these work loading and unloading conditions, wedge mechanism 60 is solely cantilever supported by the headstock 44. However, when fixtures 40 and 42 are initially closed together at parting line P/L in the die-retracted condition shown in FIG. 2, cam nose 270 is partially inserted into guide bore 272 of plug 140 to provide radial load bearing support and alignment for the free end of wedge mechanism 60 during segmental die radial expansion travel in working stroke W/SR.

Each of the cone cams 200, 202 and 204 comprises a solid disc having a circular peripheral array of sixteen inclined flat external camming surfaces 274, 276 and 278 respectively individually slidably mating with complementary inclined internal camming surfaces 280, 282 and 284 of the associated die holders 62, 100 and 130. The slidable interengagement of these respective camming surfaces of the cone cams 200, 202 and 204 and associated die holders 62, 100 and 130 produces by cam wedging action the radial expansion of, and permits the radial contraction of, the die holders in response to relative axial movement between the cone cams and associated die holders during travel of tailstock 46 toward and away from headstock 44 in axial working stroke W/SA.

Cone cams 200 and 202 are keyed against rotation relative to headstock 44 by a pin 288 (FIG. 1A) fixed at one end to bushing 230 and extending slidably through a bore 290 in cone cam 200 and a bore 292 in cone cam 202. Cone cam 204 is likewise keyed against rotation relative to headstock 44 (FIGS. 1A and 1B) by a pin 294 fixed at one end in cone cam 204 and slidable at the other end in a bore 296 in cone cam 202. Hence, each cone cam 200, 202 and 204 is individually threadably movable axially of wedge mechanism 60 to any desired set-up location by individually rotating its associated carrier sleeves 214, 212 and shaft 210 respectively. These cam carriers thus serve both as cam supports and as set-up adjustment lead screws for selectively adjusting each cone cam. The precision adjusted axial position of each cone cam relative to wedge mechanism 60 in turn determines the end limit of outward radial travel of the associated die holder in its working stroke W/SR for a given axial working stroke W/SA, to thereby set the finished diametrical dimension of each of the three zones of rim 20 as individually expanded by the three cone cams.

Figure 3:
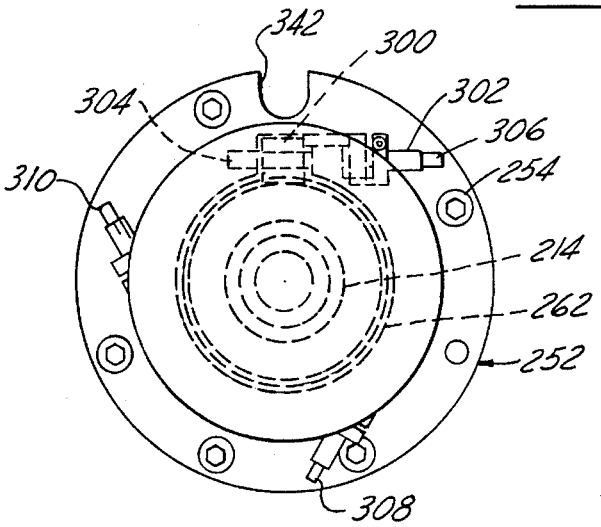
FIGS. 3, 4 and 5 are fragmentary sectional views and respectively taken on the lines 3—3, 4—4, and 5—5 of FIG. 1A.

To adjust the cone cam axial position, manual rotation of the respective cone cam lead screws, i.e., shaft 210 and sleeves 212 and 214, may be employed by providing suitable hand knobs (not shown) at their left-hand ends exteriorly of headstock 44. It is preferred, however, to provide a high ratio geared driving system for compounding the mechanical advantage of the cone cam wedging action, enabling precision micro-adjustment and providing friction locking angles in the adjustment mechanism. Thus, each of the helical gears 256, 260 and 262 are rotatably driven by an associated worm gear fixture mounted in housing 252. As best seen in FIGS. 1A and 3, the worm gear drive for set-up adjustment of the inboard cone cam 200 comprises a worm gear 300 fixed on a drive shaft 302 journalled at its inner end 304 in a bore provided in housing 252 and protruding at its outer end 306 tangentially from the exterior of the housing. Gear 300 meshes with gear 262 to thereby rotatably drive outer sleeve 214 for threadably shifting cone cam 200 axially of wedge mechanism 60 to a desired adjusted set-up position. Likewise, two additional identical worm screw driving fixtures are mounted at 120° spacing in housing 252 (as shown only partially in FIG. 3) to provide exteriorly exposed worm gear driving shafts 308 and 310 for rotating associated worm gears (not shown) respectively meshed with gears 260 and 256 for respectively threadedly adjusting the set-up position of cone cams 202 and 204 axially of the wedge mechanism 60.

Figure 7:
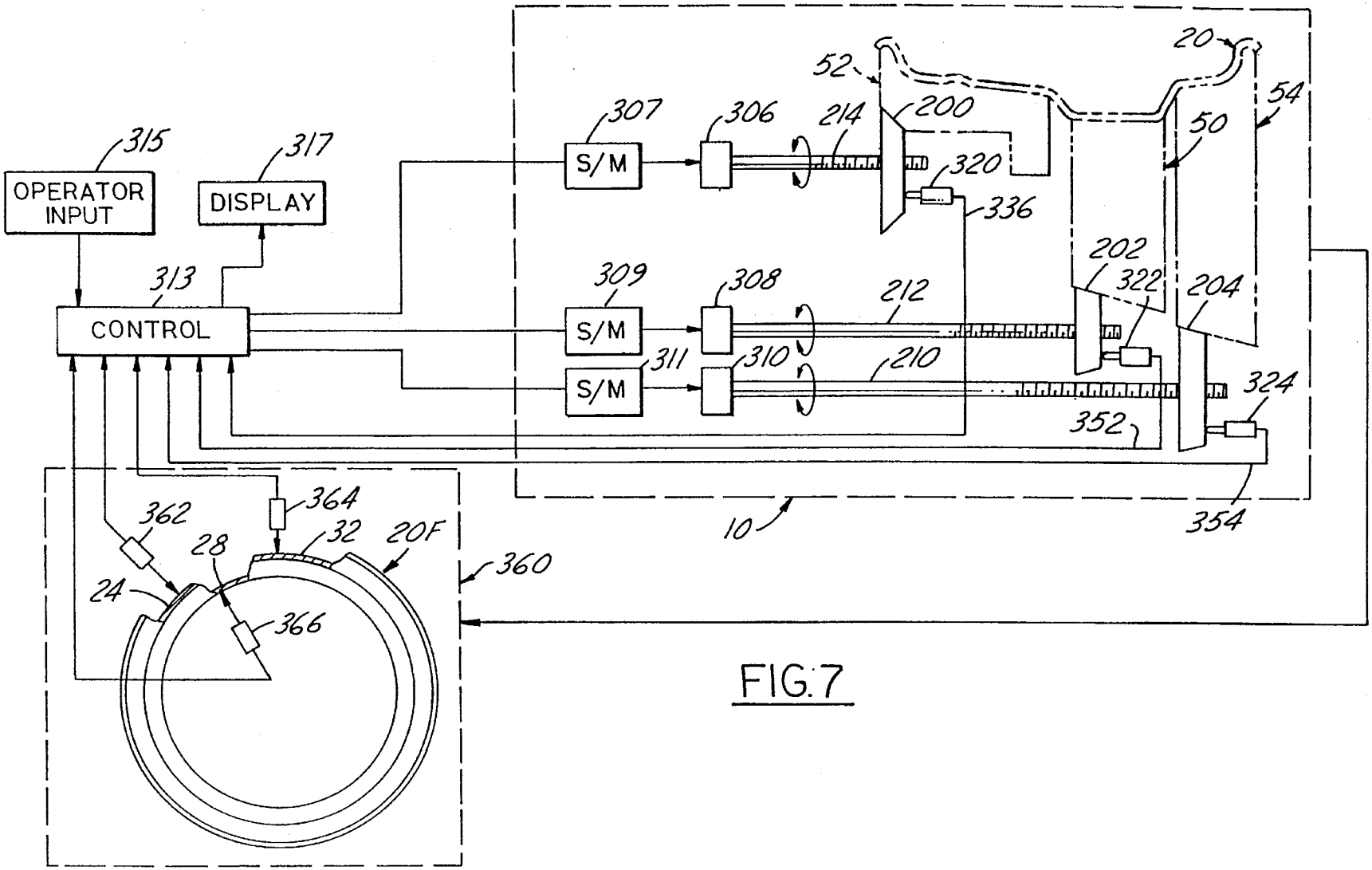
FIG. 7 is a functional block and schematic diagram of one embodiment of the apparatus control system of the invention.

Although each of the worm gears may be manually rotated to provide set-up adjustment, it is preferred to provide as shown schematically in FIG. 7, conventional electrical stepper motor or servo motor drives 307, 309 and 311 individually coupled one to each of the worm gear drive shafts 306, 308 and 310 respectively, and electronically controlled by a conventional servo motor control system 313 for ease and accuracy, as well as reliability of operation. Although such a servo motor cam control system may be designed for open loop operational control of the cone cam set-up adjustment by operator input 315, in accordance with a further feature of the invention it is preferred to provide a closed loop feedback control system for individual and/or conjoint set-up adjustment of the cone cams.

Figure 4:
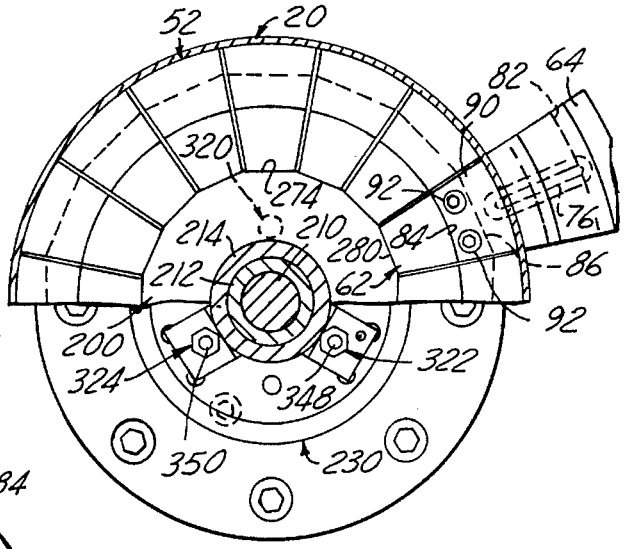
Figure 5:
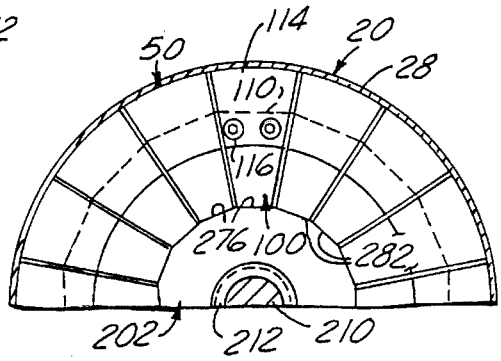
Figure 6:
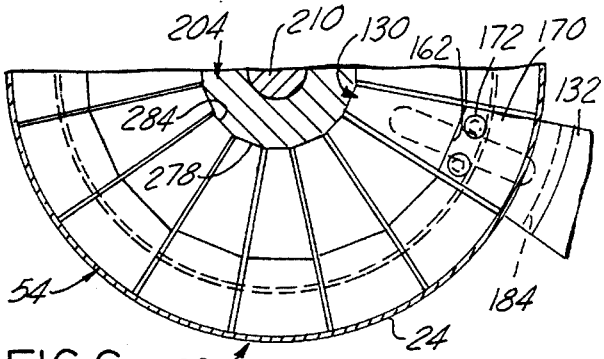
FIG. 6 is a fragmentary sectional view taken on the line 6—6 of FIG. 1B.

In order to develop system control signals for either open or closed loop cam set-up control, three identical conventional position sensors 320, 322 and 324 (FIGS. 2 and 4) are mounted individually in associated parallel bores 325 provided in bushing 230 and located at 120° angular increments as shown in FIG. 4. Referring to FIG. 1A, sensor 320 has a threaded mounting sleeve 326 threaded through a mounting bracket 328 which in turn is fastened to the end face of a mounting cavity in bushing 230, sleeve 326 being further secured by a lock nut 330. A sensing probe 332 of sensor 320 protrudes axially into a cavity 334 in cone cam 200 and is biased into yieldable abutment with the cavity end wall. As shown in FIG. 2, the electrical leads 336 for sensor 320 are fed through the headstock 44 through bore 325 and openings 338, 340, 342 and 344 provided respectively in mounting plate 240, plate 246, housing 252 and back plate 346 of headstock 44. Sensors 322 and 324 likewise have sensing probes 348 and 350 which respectively extend through suitable passageways (not shown), one in cone cam 200 for probe 348, and the other through both cone cams 200, 202 for probe 350. Probes 348 and 350 respectively yieldably abut the headstock sides of cone cams 202 and 204. Although in FIGS. 1A and 2 these probes 332, 348 and 350 are shown schematically as being in alignment, as will be understood from FIG. 4 they are actually spaced 120° from one another, as are their associated passageways through cone cams 200, 202. The electrical leads 352 and 354 (FIG. 7) for sensors 322 and 324 are likewise fed through their mounting bores and the aforementioned passageway openings 340, 342 and 344.

Referring to FIG. 7, the three position sensor leads 336, 352 and 354 are suitably operably coupled to a conventional electronic control panel 313 in a computer control system provided with a suitable visual display 317, as will be well understood by those skilled in the art and therefore shown only functionally herein. Each of the sensing probes 320, 322 and 324 thus is operable to provide an output signal indicative of the position of its associated cone cam 200, 202, and 204 axially of wedge mechanism 60. This signal in turn is processed through suitable control circuitry 313 to control the servo motor drives 307, 309, 311 of each cone cam lead screw 214, 212, 210. Hence the desired end limit of radial outward travel of each array 50, 52 and 54 of die segments may be conveniently programmed into the set-up adjustment of the rim expanding mechanism of the invention.

Additionally, as also shown schematically in FIG. 7, a conventional feedback control system may be advantageously provided in accordance with a further feature of the present invention to augment the set up adjustment in a rim manufacturing production line. For example, a suitable commercially available rim measuring station 360 may be installed immediately downstream of the rim sizing apparatus 10, such as a commercially available type of rim radial run-out measurement system similar to that disclosed in Ravenhall U.S. Pat. No. 3,951,563 (which is incorporated herein by reference). With such rim measuring equipment 360, the finished dimensions of each of the three aforementioned critical diametrical dimensional parameters of rim 20 may be 100 percent measured and continuously monitored as each rim emerges from the rim expand station. Thus, any deviations from the desired diametrical and/or radial run-out tolerances of the rim outboard and inboard bead seats 24 and 32 as well as in rim well 28 will be detected immediately after each work cycle of the rim expand apparatus 10.

As indicated schematically in FIG. 7, the finished rim 20F is shown loaded in measuring station 360 and, with a portion of the rim broken away to illustrate the finished outboard bead seat 24 inboard bead seat 32 and rim well 28. Electronic dimension sensing guages 362, 364 and 366 respectively are operably provided in association with outside surfaces of the bead seats and the inside surface of the rim well. Sensors 362, 364 may either run on these surfaces of revolution as rim 20F is rotated by associated conventional rim fixturing of station 360, or three suitable apparatus circumferentially spaced arrays of such sensors may be utilized in a non-rotary fixture set-up.

The set-up control system 313 is suitably provided with conventional information processing circuitry for feedback of this information from sensors 362, 364, 366 of the measuring station 360 to the servo motors 307, 309, 311 for controlling the cam set-up of the rim expanding apparatus 10 to suitably adjust individually one or more of the cone cams 200, 202 and/or 204 as required to compensate for the detected deviation in the previously just-finished rim 20F. Such automatic micro adjustment requires only a fraction of a second and preferably is performed through the feedback control circuitry 320–324, 362–366 and 313 and servo motor drives 307, 309, 311 of the cone cam lead screws 214, 212, 210 as a running adjustment on each piece during production. Hence such set-up re-adjustment is readily performed during either the load or unload cycle motion of the tailstock 46 relative to the headstock 44 when the segmental expand dies are in a relatively unstressed condition. This system thus provides a real-time expand die set-up system ideally adapted to monitor and control on a continuous basis the finished shape and dimensions of rim 20.

Of course, during initial set up of the segmental die expand fixtures 40, 42, as when changing die segments of arrays 50, 52 and/or 54 for different sizes and types of wheel rims, the radially outward travel end limits of the die segments in each array can be readily adjusted, via operator input 315 of control 313, by a set up operator dialing the desired position of each cone cam in an open loop control mode. Thus, when it is desired to adjust the rim diametrical sizing set-up, each of the three die arrays 50, 52 and 54 may be separately, either sequentially or simultaneously, adjusted radially of the tooling axis or center-line C-L. This is done by controllably operating the associated adjustment worm gearing to selectively rotate the associated lead screw 210, 212 and/or 214, and thereby threadably drive the associated expand cones 204, 202 and/or 200 axially back or forth to a desired set-up position relative to the associated die holder array. By observing display 317, the set-up operator can easily and precisely individually adjust and control the radially outward travel end limits of the expand die segments for each of the three critical zones of the rim being shaped and sized, namely rim outboard bead seat 24, rim drop center well 28 and rim inboard bead seat 32. This set-up adjustment can be accomplished in a matter of minutes during initial set-up as compared to the hours hitherto required to manually disassemble and reassemble the die segment arrays to insert adjustment shims in prior art rim expanding apparatus.

In the machine cycled operation of rim expanding apparatus 10, after the rough rolled rim workpiece has been moved to loading position with tailstock 46 separated from headstock 44, the rim expand machine is cycled to cause tailstock 46 to bring fixture assembly 42 into abutment with fixture assembly 40 at parting line P/L. At this point in the cycle the rim expansion segmental die arrays 50, 52 and 54 are biased into their fully retracted positions shown in FIG. 2 by their respective retracting springs 106, 80 and 186. Expander wedge mechanism 60 is thus positioned as shown in FIG. 2 relative to tailstock 46 with an axial working stroke gap indicated as "W/SA" at the space between the free end of nose 270 of expand cone 204 and the end wall of bore 272 in plug 140.

Continued machine cycle motion of tailstock 46 toward headstock 44 (to the left as viewed in FIG. 2) now moves the three die holder arrays 130, 100 and 62 as a unit axially along the fixed wedge expanding mechanism 60 through working stroke W/SA. It is to be understood that stroke W/SA is a pre-set distance as conventionally provided in the set-up adjustment of the rim expanding machine or press carrying the tooling apparatus 10 of the invention. This axial work stroke motion of the assembly fixtures 40, 42 toward headstock 44 is yieldably resisted by a suitable conventional press cushion mechanism, herein illustrated as an air spring provided by a piston plate 400 carried in headstock 44. Piston 400 is slidably mounted on bushing 230 at its center opening 402 and slidably mounted at its outer periphery 404 in a ring cylinder 406 suitably fixed to platen 246. Piston 400 has fixed thereto the holder guide clamps 68 and 70 so that the entire headstock die fixture assembly 40 is carried on piston 400 for axial movement therewith. FIGS. 1A and 1B show fixtures 42 and 40 at their end limit of expansion work stroke travel axially along wedge mechanism 60, as also will be seen by comparing the bottomed condition of nose 270 in plug 140 illustrated in FIG. 1B to the retracted position of these parts at the beginning of the work stroke shown in FIG. 2.

As the die holder arrays 50, 52 54 are thus moved axially to the left as viewed in FIG. 2, the inclined holder cam surfaces 280, 282, 284 slidably forced axially along and radially outwardly on the associated cone cam surfaces 274, 276, 278, thereby concurrently forcibly driving the associated die holders 62, 100, 130 radially outwardly by a wedging action to a predetermined radial outer travel limit, as indicated by the radial expansion working stroke labeled W/SR in FIG. 2. During this radial expansion, the metal material of the undersized rolled rim workpiece is circumferentially stretched beyond its yield point by the arrays of segmental expansion dies 90, 114, 170 and thus the rim material takes a permanent set at its finished expanded contour and dimensions as determined by these expansion dies.

The foregoing sequence is machine-reversed to cause the expansion dies to retract to their position shown in FIG. 2 to release the finished rim and to separate tailstock 46 from headstock 44 to unload rim 20 from the machine. A travel limit cushion stop ring 408 is provided on piston 400 to limit axial movement of die fixture assembly 40 on its return stroke toward tailstock 46.

From the foregoing description, it will now be apparent that the rim expanding apparatus 10 of the present invention provides many features, advantages on and improved results over prior art rim expanding apparatus. The triple array 50, 52, 54 of individually adjustable segmental expansion dies, as compared to the prior dual die arrays hitherto commonly utilized in rim production lines, now provides a separate die expansion array 50 for individually expanding the drop center well 28 zone of the rim. Die array 50 is independently adjustable relative to the flanking arrays 52 and 54 which respectively expand the inboard flange 34 inboard bead seat 32 zone and the outboard flange 22—outboard bead seat 24 zone of rim 20. Likewise, arrays 52 and 54 are independently adjustable relative to one another. Hence the diametrical dimensions of each of these three annular rim zones can be separately controlled relative to one another to thereby enhance the size and shape dimensional control of the wheel rim in production. As a result, downstream defects in disc and rim assembly operations are reduced and a better finished product in terms of the rim and disc wheel assembly is obtained.

Another important feature of the present invention is the provision in a multiple array expandable segmental die fixture (whether applied to a conventional dual array die fixture or to the improved three array die fixture of the present invention), of an expander cone 200, 202, 204 for each separate array 52, 50, 54, each of which is independently axially adjustable along the expander wedge mechanism 60 to individually vary the expansion limits of each array. By enabling the set up operator to dial the set up adjustment exteriorly of the rim expander machine, either manually or by automatic control as set forth previously, the tedious and time consuming manual shimming adjustments hitherto employed are eliminated. This in turn greatly reduces set up time and cost and also improves the accuracy and reliability of the set up adjustments.

The provision of the three concentric lead screw members 210, 212 and 214, rotatable independently of one another and each carrying one of the adjustment cones 204, 202, 200 threadably thereon, provides a simple, rugged and economical adjustment mechanism for such a shimless rim expander die set up. This lead screw mechanism is readily adapted to manual, electro-mechanical and/or electronic control for either open or closed loop operation.

The augmentation of the system of the invention by the proximity sensor feedback mechanisms 320, 322, 324 enables real-time, 100% monitoring and adjustment for each successive rim workpiece during a production run. With such control system (FIG. 7) coupled to the set up adjustment mechanism, running variations in stock material and thickness, tool wear and other factors tending to produce out of tolerance conditions in the rim sizing operation can be rapidly and economically compensated for at minimum cost and with reduced scrap. This in turn results in high quality, precision rim sizing in an economical manner at production line rates.

Although the present invention has been illustrated and described with reference to a specific exemplary method and apparatus, it will be understood that various modifications may be made by persons skilled in the art without departing from the spirit of the invention. For example, because of the provision of an expander wedge carrying a separate cone cam expander for separately actuating each of the multiple die arrays, and because each die array is movable radially relative to the other die arrays by sliding abutment therebetween, it is possible to vary the cam contour of each cone cam and the complimental cam surface of the associated die holder from the straight-line, equal camming angle configuration illustrated herein. Hence by providing different but cooperating individual cam contours for each array, the rate of radial expansion of each array can be varied relative to the rate of the expansion of the other arrays. Hence it will now be understood that such a modification can be utilized to cause the rim to be expanded in each of the three separate zones in a different relatively varying expansion sequence and/or at a different expansion rate, if desired. In addition, if desired, the uniform and linear inclination of the cone cam and holder surfaces as illustrated can be modified to provide cooperative curvature to these surfaces to thereby further mechanically program the rate of stretching of the rim as it takes a permanent set, i.e., to provide a different predetermined rate curve of expansion (die segment velocity vs. working stroke radial travel increment) of each rim zone.

The lead screw cone cam set-up adjustment mechanism as described hereinabove also can be programmed to be an active element in producing driving force for radial expansion of die arrays 50, 52, 54 supplemental to the main wedging force developed by expander 60 in response to the headstock-tailstock closing motion produced by the conventional main driving system of the rim expander machine. In other words, the cone cams can be driven to move axially within predetermined axial travel limits either before, during or after the fixtures 40 and 42 complete their relative working stroke motion W/SA. It will also now be understood by those skilled in the art that the rate and sequence of such cone cam working motion can also be readily computer programmed independently for each cone cam by suitably utilizing the above-described servo-motor control system 13 as a supplemental expansion drive system.

In addition, it will now be understood that the feature of a separate adjustable cone cam for each die holder array of the present invention may also be advantageously applied to the "dual-cone" type (i.e., opposed pair of wedge expanders) of separable segmental die expanders of the prior art, and the feature of a triple independently adjustable segmental die array also may be applied with such dual-opposed type wedge expanders.

The rim expansion sizing apparatus 10 of the present invention also may be readily augmented with known rim anti-chording structure (not shown), such as providing teeth extending from the mutually facing surfaces of the die segments to mate with recesses defined by the teeth of the adjacent die segment such as disclosed in the U.S. Pat. Nos. to Nokes 3,575,035 (FIG. 11), Bulgrin 3,509,755 (FIG. 12) and Yokomizo et al 5,010,759 (FIGS. 3A and 3B), and/or anti-chording split rings encircling the arrays of expander die segments such as disclosed in the U.S. Pat. Nos. to Seeman 3,382,699 (FIGS. 1, 2A and 2B) and Yokomizo et al 5,010,759.

Also, suitable conventional die lubrication systems are preferably provided for the rim expander apparatus 10, such as exteriorly arranged encircling tubing and associated nozzles for power spray or gravity drip application of conventional liquid die lubricants to lubricate the hereinabove described sliding surfaces of die fixtures 40, 42 and expander 60.

Accordingly, the present invention is intended to be limited solely by the appended claims and the applicable prior art.

We claim:

1. In expanding apparatus for sizing a wheel rim member having a first array of rim sizing die segment means insertable into the rim member from one side thereof, a second array of rim sizing die segment means insertable into the rim member from the opposite side thereof and cooperating with said first array to form a complete array of die segment means for expansion sizing of the complete rim member, and wedge means for moving said arrays radially outwardly to size the rim member in response to relative coaxial movement of said wedge means and said arrays in a rim expansion working stroke along a longitudinal axis of said wedge means, the improvement in combination therewith wherein said wedge means comprises an expansion cone mechanism comprising first and second cone cam means respectively individually operably associated with said first and second die segment arrays for radially expanding the same in such working stroke, and set-up adjustment means disposed interiorly of said expander wedge means and operably coupled to each of said cone cam means for selectively moving each of said cone cam means along the longitudinal axis of said wedge means to an adjusted set-up position to thereby vary the set-up end limit of radially outward movement of the associated die segment array for a given relative working stroke of said wedge means and die segment arrays.

2. The combination set forth in claim 1 wherein said set-up adjustment means comprises first and second cone cam moving means respectively operatively coupled to said first and second cone cam means and constructed and arranged coaxially of said wedge means and die segment arrays and concentrically relative to one another in telescoped relationship, said first and second cone cam moving means each having one longitudinal end thereof respectively carrying said first and second cone cam means interiorly of said arrays and each having an opposite longitudinal end disposed exteriorly of said arrays to enable set-up adjustment via said cone cam moving means exteriorly of said arrays.

3. The combination set forth in claim 2 wherein said interior longitudinal ends of said cone moving means are axially offset from one another such that one of said ends protrudes axially from the other of said ends, said first and second cone cam means being respectively operably mounted on said interior ends of said first and second cone moving means.

4. The combination set forth in claim 3 wherein said cone cam moving means and said cone cam means each have threaded interengaging means for causing said selective movement of said first and second cone cam means in response to rotation respectively of said first and second cone cam moving means about said axis.

5. The combination set forth in claim 4 further including first and second gear drive means operatively coupled to the respective exterior ends of said first and second cone cam moving means for individually rotating said first and second cone cam moving means.

6. The combination set forth in claim 5 wherein each of said gear drive means includes a worm gear drive for each of said cone cam moving means and a servo-motor means operably coupled to each said worm gear drive for selectively controlling the adjusted set-up position of said cone cam means.

7. The combination as set forth in claims 1, 2, 3, 4, 5 or 6 wherein said expansion cone mechanism further includes position sensor means constructed and arranged interiorly of said arrays and operable for developing a signal indicative of the axially adjusted set-up position of each of said cone cam means, and means for utilizing said position indicating signals for controlling said servo motors to drive said cone cam means and thereby control the adjusted set-up positions of said cone cam means.

8. A method of sizing a one-piece wheel rim first rough formed as a slightly undersize rim element workpiece from a hoop of a metal strip stock having a cross-sectional contour approximately that of the finished rim with a first annular zone including an outboard tire bead seat of said rim, a second annular zone including a central section in said rim and a third annular zone including an inboard tire bead seating surface of said rim, said method comprising the steps of:

(1) providing first, second and third segmental radial expansion die arrays respectively associated solely with the first, second and third rim zones and individually radially adjustable relative to one another with respect to the outside diameter of each of the arrays in their respective fully radially expanded conditions, and (2) permanently deforming the rim workpiece by radially expanding the same to form a wheel rim of finished dimensions at least as to the outside diameters of the bead seats and the inside diameter of the central section by forcing radially outwardly each of said arrays to radially expand said arrays and thereby form the associated rim zone into an expanded condition to thereby size each rim zone separately from the sizing action of the segmental expansion die arrays utilized for expansion sizing of the other two rim zones.

9. The method of claim 8 wherein said expanding step is performed by causing each array to produce a uniform rate of expansion of the rim zones.

10. The method of claim 8 wherein said expanding step is performed by causing the arrays to produce a non-uniform rate of expansion among the rim zones.

11. The method of claims 8, 9 or 10 wherein said expanding step is performed by causing the arrays to produce a variable sequence of expansion relative to one another.

12. Apparatus for sizing a one-piece drop center wheel rim first rough formed as a slightly undersize rim element workpiece from a hoop of a metal strip stock having a cross-sectional contour approximating that of the finished rim with a first annular zone including an outboard tire bead seat of said rim, a second annular zone including a drop center well in said rim and a third annular zone including an inboard tire bead seating surface, said apparatus comprising:

(1) rim expander means comprising first, second and third segmental radial expansion die arrays of die segments individually radially adjustable relative to one another with respect to the outside diameter of each of said arrays in their respective fully expanded conditions, said arrays being constructed and arranged such that said first, second and third arrays are respectively operably associated solely with the first, second and third rim zones, and (2) wedge means constructed and arranged to adjustably cause said rim expander means to permanently deform said rim workpiece by radially expanding the same in response to movement of said wedge means in the direction of the rim axis to form a drop center wheel rim of substantially finished dimensions at least as to the outside diameter of the bead seats and the inside diameter of the well by forcing radially outwardly each of said arrays to radially expand said arrays and thereby form the associated rim zone into an expanded condition to thereby size each rim zone separately from the sizing action of the segmental expansion die arrays utilized for expansion sizing of the other two rim zones.

13. The apparatus of claim 12 wherein said wedge means is constructed and arranged to be operable to cause each of said arrays to produce a uniform rate of expansion of the rim zones.

14. The apparatus of claim 12 wherein said wedge means is constructed and arranged to be operable to cause said arrays to produce a non-uniform rate of expansion among the rim zones.

15. The apparatus of claims 12, 13 or 14 wherein said wedge means is constructed and arranged to be operable to cause said arrays to produce a variable sequence of expansion relative to one another.

16. The apparatus set forth in claim 12 wherein said wedge means is constructed and arranged for moving said arrays radially outwardly to size the rim in response to relative coaxial movement of said wedge means and said arrays in a rim expansion working stroke along a longitudinal axis of said wedge means, said wedge means comprising an expansion cone mechanism including first, second and third cone cam means respectively individually operably associated with said first, second and third die segment arrays, and further including set-up adjustment means disposed internally of said expander wedge means and operably coupled to each of said cone cam means for selectively moving each of said cone cam means along the longitudinal axis of said wedge means to an adjusted set-up position to thereby vary the set-up end limit of radially outward movement of the associated die segment array for a given relative working stroke of said wedge means and die segment arrays.

17. The apparatus set forth in claim 16 wherein said set-up adjustment means comprises first, second and third cone cam moving means respectively operatively coupled to said first, second and third cone cam means and constructed and arranged coaxially of said wedge means and die segment arrays and concentrically relative to one another in telescoped relationship, said first, second and third cone cam moving means each having one longitudinal end thereof respectively carrying said first, second and third cone cam means interiorly of said arrays and each having an opposite longitudinal end disposed exteriorly of said arrays to enable set-up adjustment via said cone cam moving means exteriorly of said arrays.

18. The apparatus set forth in claim 17 wherein said cone cam moving means each have one longitudinal end thereof disposed interiorly of said arrays, said interior ends of said cone moving means being axially offset from one another such that said interior ends of said first and second cam moving means protrude axially respectively from said interior ends of said second and third cam moving means, said first, second and third cone cam means being respectively operably mounted on said interior ends of said first, second and third cam moving means.

19. The apparatus set forth in claim 18 wherein said cone cam moving means and said cone cam means each have threaded interengaging means constructed and arranged for causing said selective movement of said first, second and third cone cam means in response to rotation respectively of said first, second and third cone cam moving means about said axis.

20. The apparatus set forth in claim 19 further including first, second and third gear drive means operatively coupled to the respective exterior ends of said first, second and third cone cam moving means for individually rotating said first, second and third cam moving means.

21. The apparatus set forth in claim 20 wherein each of said gear drive means includes a worm gear drive operably coupled to each of said cone cam moving means and a servo-motor means operably coupled to each said worm gear drive for selectively controlling the adjusted set-up position of each of said cone cam means.

22. The apparatus set forth in claims 16, 17, 18, 19, 20 or 21 wherein said expansion cone mechanism further includes position sensor means constructed and arranged interiorly of said arrays and operable for developing a signal indicative of the axially adjusted set-up position of each of said cam means, and means for utilizing said position indicating signals for controlling and servo-motors to drive said cone cam means and thereby control the adjusted set-up positions of each of said cone cam means.

23. The apparatus set forth in claim 12 wherein said first die segment array is constructed and arranged for insertion endwise into the rim element from one side thereof in a radially retracted condition of said first die segment array and said second and third die segment arrays are constructed and arranged for insertion endwise into the rim element from the side thereof axially opposite said one side in a radially retracted condition of said second and third die segment arrays, and wherein said second die and third die segment arrays include support means constructed and arranged for carrying said second die segment array on said third die segment array for unitary movement therewith along said axis and enabling slidable movement of said second array of die segments radially of said axis independently of and relative to said third array of die segments.

24. In a wheel rim shaping apparatus adapted to be mounted between a fixed member and a movable member of a horizontal or vertical axis press apparatus and having:

a first die split into a plurality of first die elements in a circumferential direction of the first die so that the first die can expand and contract in a radial direction of the first die;

a second die provided coaxially with the first die so as to be movable relative to the first die in an axial direction of the first die, the second die being split into a plurality of second die elements in a circumferential direction of the second die so that the second die can expand and contract in a radial direction of the second die;

a first die holder split into a plurality of first die holder elements in a circumferential direction of the first die holder, a first spring means yieldably urging each of the first die holder elements in a radially inward direction of the first die holder, said first die holder elements engaging the first die so as to expand and contract the first die;

a second die holder split into a plurality of second die holder elements in a circumferential direction of the second die holder, a second spring means urging each of the second die holder elements in a radially inward direction of the second die holder, said second die holder elements engaging the second die so as to expand and contract the second die;

a single wedge die expander means having a central axis constructed and arranged coaxially with the first and second dies for relative movement in an axial direction of said dies, said expander being capable of extending through the second die holder into the first die holder to engage the first and second die holders when said expander means and die holders are relatively moved in a direction toward one another;

a first die holder supporting means adapted to be secured to the fixed member of the press apparatus, said first die holder supporting mean supporting said first die holder for slidably mounting each of said first die holder elements for movement radially relative to said first die holder supporting means;

a second die holder supporting means adapted to be secured to the movable member of the press apparatus for movement axially of the press apparatus relative to the first die holder supporting means, said second die holder supporting means supporting said second die holder for slidably mounting each of said second die holder elements for movement radially relative to said second die holder supporting means;

expander supporting means provided on said first die holder supporting means for cantilever supporting said expander means in a separated rim-workpiece-loading and finished-rim-unloading condition of the press apparatus, said expander cantilever supporting means being movable axially relative to said first and second die holder supporting members, and expander working stroke free end supporting means adapted to be secured to the movable member of the press apparatus for securely slidably supporting said expander means at a free end during the die expansion working stroke of said expander means relative to said die holders in the closed condition of the press, the improvement in combination therewith wherein said expander means includes an expansion cone mechanism comprising a first and second cone cam means respectively individually operably associated with camming surfaces of said first and second die holders for radially expanding the same in such working stroke, and cone cam set-up adjustment means disposed interiorly of said expander means and operably individually coupled to each of said cone cam means for selectively moving each of said cone cam means along the longitudinal axis of said expander means to an adjusted set-up position to thereby vary the set-up end limit of radially outward movement of the associated said first and second dies for a given working stroke of said expander means relative to said die arrays.

25. The apparatus as set forth in claim 24 wherein said free end of said expander means comprises a nose portion on one of said cone cam means, and said free end supporting means comprises a guide member fixed to said movable member and having a guide bore for slidably receiving said nose portion.

26. Apparatus for sizing a one-piece drop center wheel rim first rough formed as a slightly undersize rim element workpiece from a hoop of metal strip stock having a cross-sectional contour approximating that of the finished rim with a first annular zone including an outboard tire bead seat of said rim, a second annular zone including a drop center well in said rim and a third annular zone including an inboard tire bead seating surface of said rim, said apparatus comprising:

(1) rim expander means comprising first, second and third segmental expansion die arrays of die segments constructed and arranged such that said first, second and third arrays are respectively operably associated solely with the first, second and third rim zones, and (2) wedge means constructed and arranged to cause said rim expander means to permanently deform said rim workpiece by radially expanding the same to form a drop center wheel rim of substantially finished dimensions at least as to the outside diameter of the bead seats and the inside diameter of the well by forcing radially outwardly each of said arrays to form the associated rim zone into an expanded condition to thereby size each rim zone separately from the sizing action of the segmental expansion die arrays utilized for expansion sizing of the other two rim zones, and wherein said wedge means is constructed and arranged for moving said arrays radially outwardly to size the rim in response to relative coaxial movement of said wedge means and said arrays in a rim expansion working stroke along a longitudinal axis of said wedge means, said wedge means comprising an expansion cone mechanism including first, second and third cone cam means respectively individually operably associated with said first, second and third die segment arrays, and further including set-up adjustment means disposed internally of said expander wedge means and operably coupled to each of said cone cam means for selectively moving each of said cone cam means along the longitudinal axis of said wedge means to an adjusted set-up position to thereby vary the set-up end limit of radially outward movement of the associated die segment array for a given relative working stroke of said wedge means and die segment arrays.

27. The apparatus set forth in claim 26 wherein said set-up adjustment means comprises first, second and third cone cam moving means respectively operatively coupled to said first, second and third cone cam means and constructed and arranged coaxially of said wedge means and die segment arrays and concentrically relative to one another in telescoped relationship, said first, second and third cone cam moving means each having one longitudinal end thereof respectively carrying said first, second and third cone cam means interiorly of said arrays and each having an opposite longitudinal end disposed exteriorly of said arrays to enable set-up adjustment via said cone cam moving means exteriorly of said arrays.

28. The apparatus set forth in claim 27 wherein said cone cam moving means each have one longitudinal end thereof disposed interiorly of said arrays, said interior ends of said cone moving means being axially offset from one another such that said interior ends of said first and second cam moving means protrude axially respectively from said interior ends of said second and third cam moving means, said first, second and third cone cam means being respectively operably mounted on said interior ends of said first, second and third cam moving means.

29. The apparatus set forth in claim 28 wherein said cone cam moving means and said cone cam means each have threaded interengaging means constructed and arranged for causing said selective movement of said first, second and third cone cam means in response to rotation respectively of said first, second and third cone cam moving means about said axis.

30. The apparatus set forth in claim 29 further including first, second and third gear drive means operatively coupled to the respective exterior ends of said first, second and third cone cam moving means for individually rotating said first, second and third cam moving means.

31. The apparatus set forth in claim 30 wherein each of said gear drive means includes a worm gear drive operably coupled to each of said cone cam moving means and a servo-motor means operably coupled to each said worm gear drive for selectively controlling the adjusted set-up position of each of said cone cam means.

32. The apparatus set forth in claims 26, 27, 28, 29, 30 or 31 wherein said expansion cone mechanism further includes position sensor means constructed and arranged interiorly of said arrays and operable for developing a signal indicative of the axially adjusted set-up position of each of said cone cam means, and means for utilizing said position indicating signals for controlling said servo-motors to drive said cone cam means and thereby control the adjusted set-up positions of each of said cone cam means.

* * * * *